US007799097B2

(12) United States Patent
Abbott et al.

(10) Patent No.: US 7,799,097 B2
(45) Date of Patent: Sep. 21, 2010

(54) PROCESSES FOR SPRAY DYEING FABRICS

(75) Inventors: Michael Abbott, Statesville, NC (US); Robert Miller, New Ringgold, PA (US); Ruth May, Schuylkill Haven, PA (US); Martin Bentham, Barnsley (GB)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 695 days.

(21) Appl. No.: 11/395,848

(22) Filed: Mar. 31, 2006

(65) Prior Publication Data

US 2006/0265813 A1 Nov. 30, 2006

Related U.S. Application Data

(63) Continuation-in-part of application No. 10/601,820, filed on Jun. 23, 2003, now Pat. No. 7,033,403.

(60) Provisional application No. 60/666,940, filed on Mar. 31, 2005.

(51) Int. Cl.
*D06B 1/02* (2006.01)

(52) U.S. Cl. ..... 8/499; 8/449; 8/543; 8/916; 8/920; 8/489

(58) Field of Classification Search ..... 8/499
See application file for complete search history.

(56) References Cited

U.S. PATENT DOCUMENTS

| | | | | |
|---|---|---|---|---|
| 2,915,230 | A | 12/1959 | Brewin et al. | |
| 2,974,838 | A | 3/1961 | Parham | |
| 2,985,502 | A | 6/1961 | Kronsbein et al. | |
| 2,990,087 | A | 6/1961 | Brewin et al. | |
| 2,990,088 | A | 6/1961 | Isken et al. | |
| 3,022,926 | A | 2/1962 | Bailey, Jr. | |
| 3,181,749 | A | 5/1965 | Storr et al. | |
| 4,612,016 | A * | 9/1986 | Jaeger et al. | 8/543 |
| 4,659,333 | A | 4/1987 | Schaub | |
| 4,717,391 | A | 1/1988 | Daniel et al. | |
| 4,786,721 | A | 11/1988 | Tzikas et al. | |
| 5,010,612 | A * | 4/1991 | Jensen et al. | 8/149.1 |
| 5,016,308 | A | 5/1991 | McBride et al. | |
| 5,205,305 | A | 4/1993 | Yamakita | |
| 5,288,322 | A | 2/1994 | Hanna et al. | |
| 5,458,265 | A | 10/1995 | Hester et al. | |

(Continued)

FOREIGN PATENT DOCUMENTS

| | | |
|---|---|---|
| DE | 196 33 101 | 2/1998 |

(Continued)

*Primary Examiner*—Harold Y Pyon
*Assistant Examiner*—Timothy Chiang
(74) *Attorney, Agent, or Firm*—Womble Carlyle Sandridge & Rice, PLLC

(57) ABSTRACT

Processes for dyeing fabric are provided. The process can include continuously moving the fabric in a machine direction; removing folds or creases from the fabric; spraying a first surface of the fabric with a dye; and exposing the fabric to atmospheric steam after spraying the dye on the first surface but prior to the dye drying on the first surface so that the dye migrates from the first surface to a second surface of the fabric and reacts with and affixes to a component of the fabric.

21 Claims, 4 Drawing Sheets

U.S. PATENT DOCUMENTS

| | | | | |
|---|---|---|---|---|
| 5,593,072 | A | 1/1997 | Hester et al. | |
| 5,713,223 | A | 2/1998 | Lin | |
| 5,951,717 | A | 9/1999 | Mrotzeck et al. | |
| 5,964,407 | A | 10/1999 | Sanddkleiva | |
| 6,063,137 | A | 5/2000 | Scheibli et al. | |
| 6,120,560 | A | 9/2000 | Miller et al. | |
| 6,393,871 | B1 * | 5/2002 | Chiang | 68/5 D |
| 6,443,569 | B1 | 9/2002 | Mheidle et al. | |
| 6,471,729 | B1 | 10/2002 | Voth et al. | |
| 7,144,431 | B2 | 12/2006 | Gardner et al. | |
| 2002/0138922 | A1 | 10/2002 | Schmiedl et al. | |

FOREIGN PATENT DOCUMENTS

| | | |
|---|---|---|
| EP | 1 275 700 | 7/2002 |
| EP | 1 233 098 | 8/2002 |
| IT | PD2001A000089 | 4/2001 |
| WO | WO 96/28604 | 9/1996 |

* cited by examiner

PROCESSES FOR SPRAY DYEING FABRICS

CROSS REFERENCE TO RELATED APPLICATIONS

This application claims benefit of U.S. Provisional Application No. 60/666,940 filed on Mar. 31, 2005, the contents of which are incorporated by reference herein. This application is a continuation-in-part of U.S. application Ser. No. 10/601,820 entitled Spray Dyeing of Garments and filed on Jun. 23, 2003, now U.S. Pat. No. 7,033,403 the contents of which are incorporated by reference herein.

BACKGROUND OF THE INVENTION

1. Field of the Invention

The present invention is related to fabric dyeing. More particularly, the present invention is related to processes of spray dyeing fabrics.

2. Description of Related Art

Today, fabrics are made from a wide-variety of natural fibers, synthetic fibers, and any combination thereof. Many processes have been proposed for dyeing fabrics.

One process, commonly referred to as yarn dyeing, involves dyeing individual fibers or yarns before the fibers are sewn or knitted into a fabric. One problem associated with such yarn dyeing process relates to inventory control of the yarns and associated garments. For example, yarn dyeing requires the garment manufacturer to maintain a supply of the various colored yarns used in its products. This can lead to an increased cost of goods.

Another dyeing process is commonly referred to as bulk dyeing. In bulk dyeing, un-dyed fibers or yarns are knitted or woven into a raw or un-dyed fabric. The raw fabric is subsequently dyed. The dyed fabric is then used to make the desired product, such as a garment.

Some common bulk dyeing processes include vat dyeing, beam dyeing, jet dyeing, and bath dyeing. Vat dyeing typically consists of immersing a piece of fabric in a vat of liquid dye. Beam dyeing involves winding a length of fabric about a perforated beam. The beam is then placed in a vessel where liquid dye is pumped into the center of the beam, out of the perforations, and through the fabric. Jet dyeing involves placing the fabric in a high-pressure, high-temperature kettle of liquid dye. Bath dyeing involves immersing the fabric in a bath of dye, which is contained in a rotating drum.

One problem associated with bulk dyeing processes relates to the large amounts of water required during processing, which can increase cost of goods for such bulk dyed fabrics.

Yet another problem with bulk dyed fabrics in the manufacture of garments is related to the unpredictability of consumer color preferences. In the garment industry, change in the consumer's preference for one color over another color can lead to an overstock of the undesired colored garments and a back order situation of the desired colored garments. Thus, garments made from bulk dyed fabrics have not proven flexible enough to meet increasing and changing consumer demands.

Further processes of dyeing fabrics involve printing a dye onto a surface of a fabric. This process is commonly used to apply a decorative pattern on the surface of the fabric. Such printing processes include screen-printing and inkjet printing. While these processes have proven useful in quickly changing from one decorative pattern to another, they have not proven useful in bulk dyeing of fabrics.

Accordingly, there is a continuing need for flexible, low cost, low waste processes of dyeing fabrics.

SUMMARY OF THE INVENTION

It is an object of the present invention to provide processes for continuously dyeing fabric to a substantially uniform color.

The process can include continuously moving the fabric in a machine direction; removing folds or creases from the fabric; spraying a first surface of the fabric with a dye; and exposing the fabric to atmospheric steam after spraying the dye on the first surface but prior to the dye drying on the first surface so that the dye migrates from the first surface to a second surface of the fabric and reacts with and affixes to a component of the fabric.

The process can include continuously moving the fabric in a machine direction; opening the fabric and ensuring that the fabric is taut so that any folds or creases in the fabric are substantially removed; spraying a first surface of the fabric with a dye while the fabric is open; and exposing the fabric to atmospheric steam after spraying the dye on the first surface but prior to the dye drying on the first surface so that the dye migrates from the first surface to a second surface of the fabric and reacts with and affixes to a component of the fabric.

A process for continuously dyeing a tubular fabric is also provided. The process includes opening the tubular fabric; spraying a first surface of the open tubular fabric with a dye; closing the tubular fabric; and exposing the closed tubular fabric to atmospheric steam after spraying the dye on the first surface but prior to the dye drying on the first surface so that the dye migrates from the first surface to a second surface of the tubular fabric and reacts with and affixes to a component of the tubular fabric.

The above-described and other features and advantages of the present invention will be appreciated and understood by those skilled in the art from the following detailed description, and drawings.

DETAILED DESCRIPTION OF THE INVENTION

Figure 1:
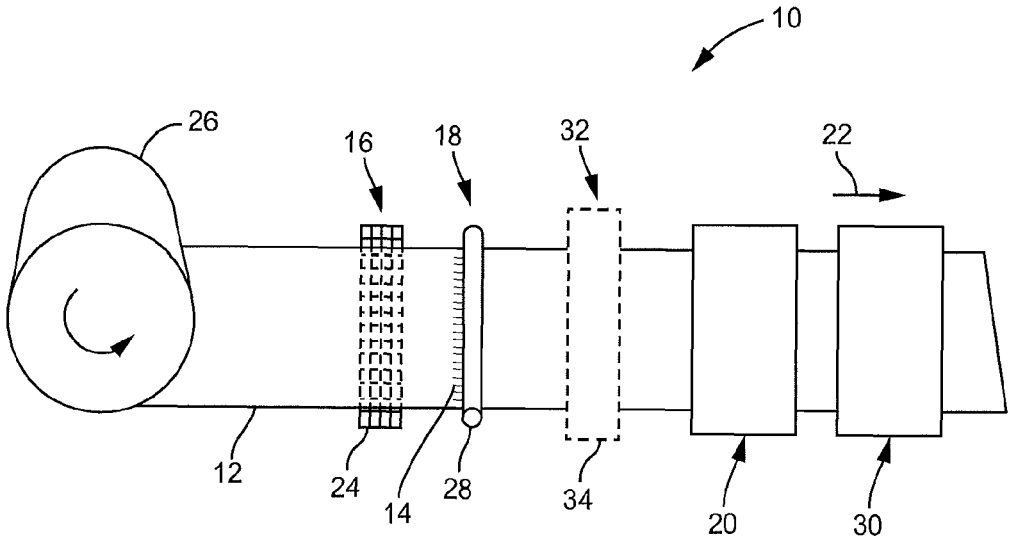
FIG. 1 is a schematic view of an exemplary embodiment of an automated process for dyeing fabric according to the present invention.

Referring to the drawings and in particular to FIG. 1, an exemplary embodiment of a process 10 according to the present disclosure is shown. Process 10 is effective at continuously dyeing a wide fabric 12 with a dye 14. Fabric 12 can be a warp knit fabric in its un-dyed or raw state.

Process 10 has a first station 16, a second station 18, and a third station 20. Fabric 12 is, preferably, moved among the first, second, and third stations 16, 18, 20 in a machine direction 22. Alternately, it is contemplated for stations 16, 18, 20 to move with respect to fabric 12 in a direction opposite to the machine direction 22. Further, it is contemplated for stations 16, 18, 20 and fabric 12 to move with respect to one another.

At first station 16, folds are removed from fabric 12. For example, first station 16 can draw fabric 12 over a former 24 so that the former ensures that the fabric is taut and, thus, any folds or creases in the fabric are substantially removed. Former 24 can be a substantially planar frame as shown in FIG. 1.

In an alternate exemplary embodiment, process 10 draws fabric 12 from a supply of fabric, such as a knitting machine or a fabric roll 26 so that the fabric is taut and, thus, any folds or creases in the fabric are substantially removed.

Next, process 10 exposes fabric 12 to second station 18 where at least one surface (e.g., technical face or technical back) of the fabric are sprayed with the dye. This is preferably achieved by controlling a spray nozzle 28 to spray fabric 12 with dye 14. In the illustrated embodiment, nozzle 28 is a stationary or fixed nozzle that sprays fabric 12 with dye as the fabric is moved in machine direction 22. Nozzle 28 can be a linear spray bar as shown. Of course, it is contemplated by the present disclosure for nozzle 28 to move with respect to fabric 12.

For purposes of clarity, former 24 is shown in FIG. 1 ending before second station 18. Preferably, first and second stations 16, 18 are at the same point along process 10 so that former 24 removes folds and creases from fabric 12 in the area of spray nozzle 28. Thus, process 10 provides former 24 at least in the area of second station 18.

Process 10 then exposes fabric 12 to third station 20 before dye 14 dries on the fabric. Third station 20 spreads dye 14 throughout fabric 12 and affixes the dye to the fabric so that the dye reacts with and affixes to a component of the fabric 12. The term "reactive" or "reacts" as used herein shall mean the action of the dye with the fabric that results in the formation of an attachment to the one or more components of the fabric, wherein the attachment can be a covalent bond, an ionic bond, a disbursement into the fiber molecule, or any combination of the foregoing.

For example, the fabric 12 can be a polyamide fabric with or without an elastic yarn, including elastane, lycra, nylon, spandex, or any combinations thereof. Dye 14 can be a dye as in U.S. Pat. No. 4,786,721, U.S. Patent Application 2002/0138922A1, European Patent Application No. EP 1 275 700, and other dyes.

In one embodiment, fabric 12 is a synthetic polyamide fabric and dye 14 is a water-soluble dye that reacts with and affixes to an amine site of the fabric so that the dye can bind with the fabric. The reaction of dye 14 with the amine sites of fabric 12 affixes the dye to the fabric through the formation of a covalent bond. It has been found that dye 14 provides a degree of fixation to and penetration into the individual fibers of fabric 12. This fixation of dye 14 to fabric 12 is sufficient to allow the dye to be sprayed on only on one surface of the fabric (e.g., technical face), while providing substantially uniform color at the second surface (e.g., technical back).

Fabric 12 is described above by way of example as a synthetic polyamide fabric. Additionally, dye 14 is described above by way of example reacting with an amine site of the synthetic fabric. However, it is contemplated by the present invention for fabric 12 to be made of any natural fiber, synthetic fiber, or any combination thereof. Similarly, it is contemplated by the present invention for dye 14 to be any fiber-reactive compound. For example, dye 14 can be a dye capable of reacting with and/or chemically bonding to the hydroxyl groups of cellulose fibers (e.g., cotton), the amino, carboxy, hydroxy and/or thiol groups of wool or silk fibers, and/or the amino groups and/or carboxy groups of synthetic polyamides.

Third station 20 exposes fabric 12 to steam and heat in a manner and amount sufficient to spread dye 14 throughout fabric 12 and affix the dye to the fabric. For example, third station 20 can have a steam hood that exposes fabric 12 to steam and heat in a manner and amount sufficient to spread dye 14 throughout fabric 12 and affix the dye to the fabric as the fabric is continuously moved through the third station 20. When affixing dye 14 to fabric 12 made of natural fibers, third station 20 can apply saturated steam, such as atmospheric steam (i.e., steam at atmospheric pressure) at a temperature of about 102 degrees Celsius and a relative humidity of about 100 percent. Third station 20 can apply steam to fabric 12 for about 1 to 7 minutes, preferably about 3 to 5 minutes. When affixing dye 14 to fabric 12 made of synthetic fibers and/or combinations of natural and synthetic fibers, third station 20 can apply saturated steam, such as superheated steam (i.e., steam at atmospheric pressure) at a temperature of up to about 130 degrees Celsius and a relative humidity of upto about 100 percent.

After dye 14 has been spread through and affixed to fabric 12 at third station 20, fabric 12 can be exposed to a fourth station 30. Fourth station 30 can wash off or remove any unfixed dye 14 from fabric 12.

Advantageously, process 10, with or without the use of former 24, minimizes contact with fabric 12 to reduce the surface area for condensation to gather and reduce dye bounce off, allows sprayed dye to pass through the garment, minimizes the formation of condensation by on the former. Thus, process 10 also eliminates or mitigates many of the deleterious effects that can occur during spray dyeing.

In some embodiments, process 10 can include a fifth station 32 positioned between second station 18 and third station 20 as shown in phantom. Fifth station 32 can include a heating device 34 for adjusting the moisture content of fabric 12 after application of dye 14 at second station 18, but before exposure to the steam of third station 20. For example, heating device 34 can include a radiant heating device, a convection device, or any combinations thereof.

Importantly, fifth station 32 does not dry dye 14 or fabric 12. Rather, fifth station 32 adjusts the moisture content of fabric 12. After exposure to second station 18, fabric 12 has a moisture content of between about 30% to about 100%, and all subranges therebetween. Preferably, fifth station 32 adjusts the moisture content of fabric 12 to between about 20% to about 80% prior to exposure to third station 20.

Without being limited to any particular theory, it is believed that the heat from fifth station 32 is sufficient to act as a catalyst to start the reaction of dye 14 with fabric 12, which assists process 10 in yielding a fixation rate of the dye to the fabric 12 of between about 80% to about 90%. In addition, fifth station 32 may assist in preventing dye 14 from dripping from fabric 12 prior to exposure to third station 20.

Figure 2:
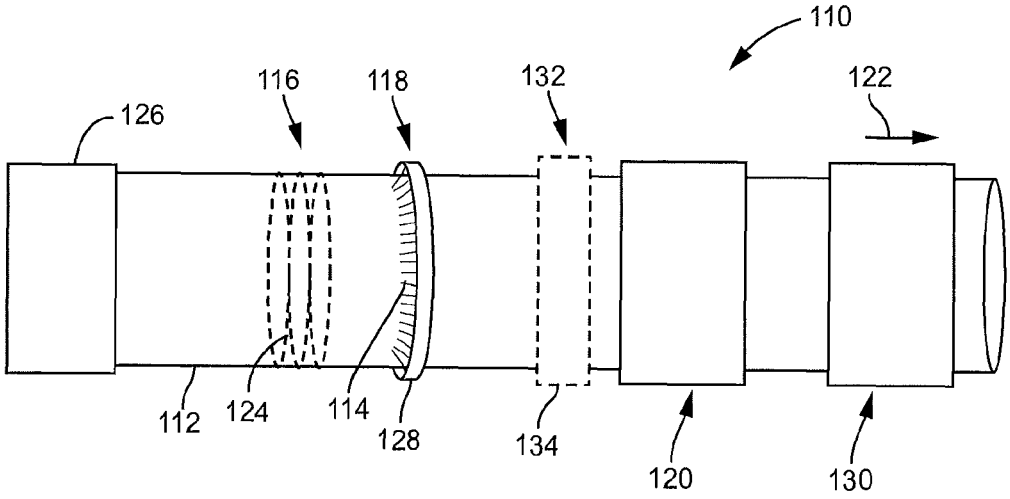
FIG. 2 is a schematic view of another alternate exemplary embodiment of an automated process for dyeing fabric according to the present invention.
Figure 3:
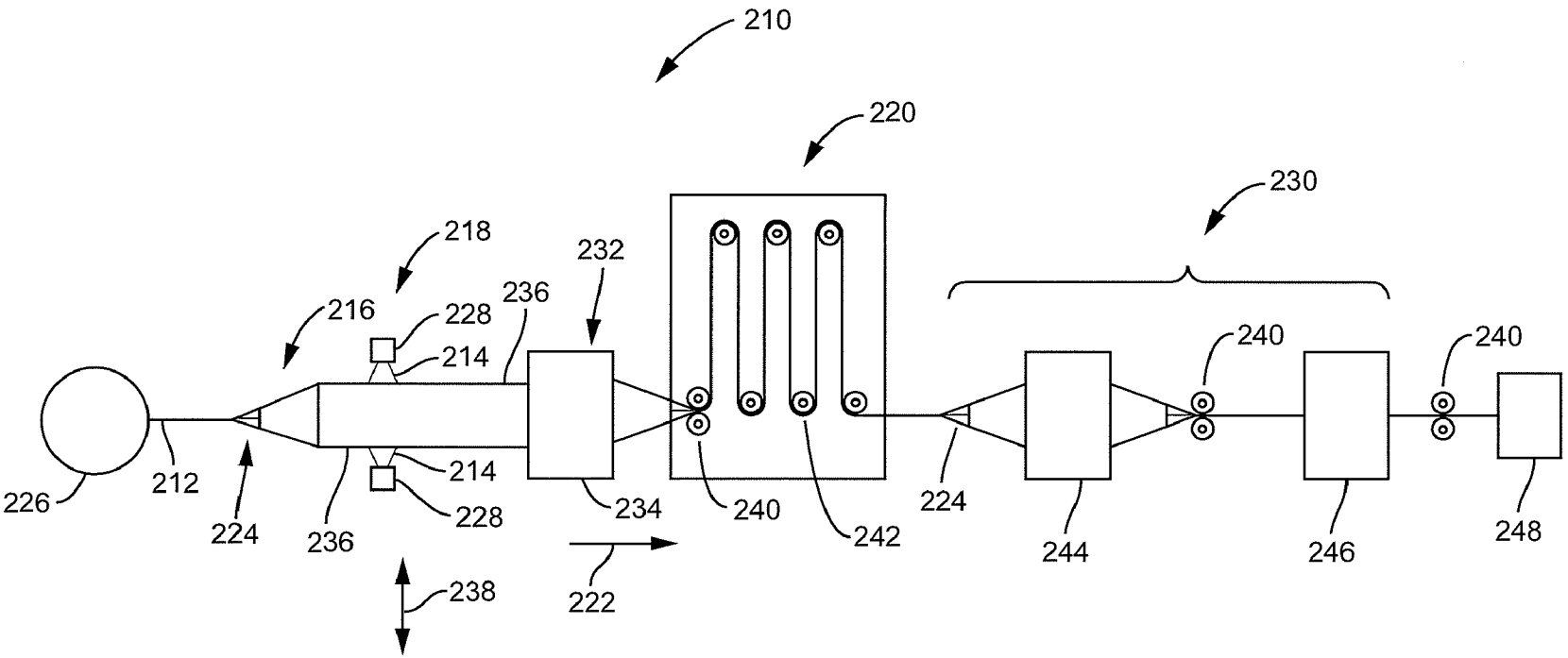
FIG. 3 is a top schematic view of another alternate exemplary embodiment of an automated process for dyeing fabric according to the present invention.

Alternate exemplary embodiments of the process according to the present disclosure are shown in FIGS. 2 and 3, where component parts performing similar and/or analogous functions are labeled in multiples of one hundred.

In the embodiment illustrated in FIG. 2, process 110 is shown continuously dyeing a tubular fabric 112 with dye 114. Fabric 112 can be a circular or weft knit fabric in its un-dyed or raw state.

Process 110 has a first station 116, a second station 118, and a third station 120. Fabric 112 is, preferably, moved among the first, second, and third stations 116, 118, 120 in a machine direction 122. Alternately, it is contemplated for stations 116, 118, 120 to move with respect to fabric 112 in a direction opposite to the machine direction 122. Further, it is contemplated for stations 116, 118, 120 and fabric 112 to move with respect to one another.

At first station 116, folds are removed from fabric 112. For example, first station 116 can draw fabric 112 over a former 124 so that the former opens the tubular fabric to knitted size width and ensures that the fabric is taut and, thus, any folds or creases in the fabric are substantially removed. Former 124 can be one or more substantially tubular frames as shown in FIG. 2. As used herein, the term "open" when used with respect to tubular fabric shall mean that the interior surface (e.g., the technical back) of the fabric does not contact itself.

In an alternate exemplary embodiment, process 110 can draw fabric 112 from a supply of fabric, such as a roll of circular-knit fabric or a circular-knitting machine 126 so that the fabric is taut and, thus, any folds or creases in the fabric are substantially removed.

Next, process 110 exposes fabric 112 to second station 118 where an exterior surface (e.g., technical face) of the fabric is sprayed with the dye. This is preferably achieved by controlling a spray nozzle 128 to spray fabric 112 with dye 114. In the illustrated embodiment, nozzle 128 is a stationary or fixed nozzle that sprays fabric 112 with dye as the fabric is moved in machine direction 122. Nozzle 128 can be a circular spray bar as shown. Of course, it is contemplated by the present disclosure for nozzle 128 to move with respect to fabric 112.

For purposes of clarity, former 124 is shown ending before second station 118. Preferably, first and second stations 116, 118 are at the same point along process 110 so that former 124 removes folds and creases from fabric 112 in the area of spray nozzle 128. Thus, process 110 provides former 124 at least in the area of second station 118.

Process 110 then exposes fabric 112 to third station 120 before dye 114 dries on the fabric. Third station 120 spreads dye 114 throughout fabric 112 and affixes the dye to the fabric. As discussed above, third station 120 can have a steam hood that exposes fabric 112 to steam and heat in a manner and amount sufficient to spread dye 114 throughout fabric 112 and affix the dye to the fabric as the fabric is continuously moved through the third station. When affixing dye 114 to fabric 112 made of natural fibers, third station 120 can apply saturated steam, such as atmospheric steam (i.e., steam at atmospheric pressure) at a temperature of between about 60 to about 102 degrees Celsius and a relative humidity of about 100 percent. Third station 120 can apply steam to fabric 112 for about 1 to 7 minutes, preferably about 3 to 5 minutes. When affixing dye 114 to fabric 112 made of synthetic fibers and/or combinations of natural and synthetic fibers, third station 120 can apply saturated steam, such as superheated steam at a temperature of up to about 130 degrees Celsius and a relative humidity of upto about 100 percent.

After dye 114 has been spread through and affixed to fabric 112 at third station 120, fabric 112 can be exposed to a fourth station 130. Fourth station 130 can wash off or remove any unfixed dye 114 from fabric 112.

Advantageously, process 110, with or without the use of former 124, minimizes contact with fabric 112 to reduce the surface area for condensation to gather and reduce dye bounce off, allows sprayed dye to pass through the garment, minimizes the formation of condensation by on the former. Thus, process 110 also eliminates or mitigates many of the deleterious effects that can occur during spray dyeing.

Process 110 can also include a fifth station 132 positioned between second station 118 and third station 120 as shown in phantom. Fifth station 132 can include one or more heating devices 134 (only one shown) for adjusting the moisture content of fabric 112 after application of dye 114 at second station 118, but before exposure to the steam of third station 120. For example, heating device 134 can include a radiant heating device, a convection device, or any combinations thereof. Preferably, process 110 includes both a plurality of heating devices 134 configured to generate a curtain of hot air (not shown) through which fabric 112 moves. In some embodiments, the curtain of hot air can assist in transporting fabric 112 into third station 120.

Importantly, fifth station 132 does not dry dye 114 or fabric 112. Rather, fifth station 132 adjusts the moisture content of fabric 112. After exposure to second station 118, fabric 112 has a moisture content of between about 30% to about 100%. Preferably, fifth station 132 adjusts the moisture content of fabric 112 to between about 20% to about 80% prior to exposure to third station 120.

In the embodiment illustrated in FIG. 3, process 210 is shown continuously dyeing a tubular fabric 212 with dye 214. Fabric 212 can be a circular or weft knit fabric in its un-dyed or raw state.

Process 210 has a first station 216, a second station 218, a third station 220, a fourth station 230, and, if needed, a fifth station 232. Fabric 212 is, preferably, moved among the stations in a machine direction 222. Alternately, it is contemplated for the stations to move with respect to fabric 212 in a direction opposite to the machine direction 222. Further, it is contemplated for the stations and the fabric 212 to move with respect to one another.

At first station 216, fabric 212 is opened and folds or creases are removed from the fabric. For example, first station 216 can draw fabric 112 from a supply of fabric 226 through an air bearing opening unit 224, known in the art, the former opens the tubular fabric and ensures that the fabric is taut and, thus, any folds or creases in the fabric are substantially removed. Advantageously, air bearing unit 224 maintains fabric 212 in the open state as the fabric moves through second station 218 and, when present, fifth station 232.

Figure 4:
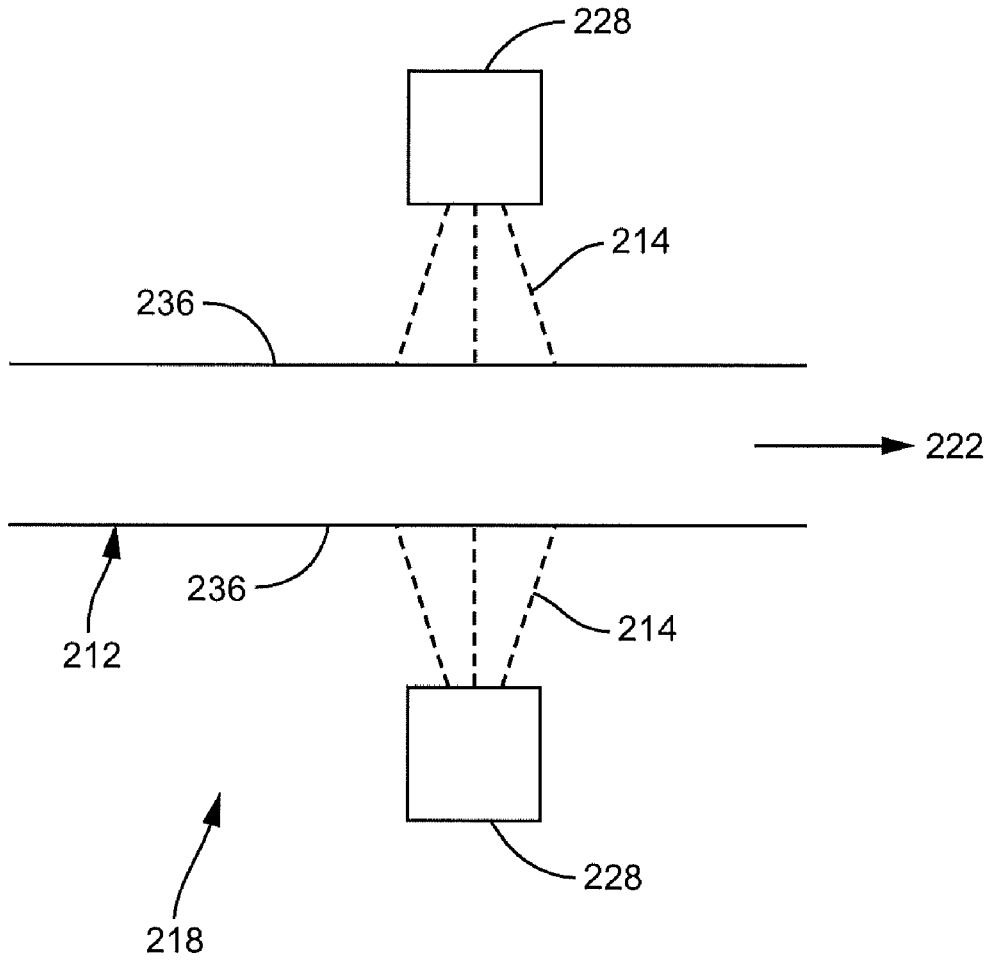
FIG. 4 is a side view of the second station of FIG. 3.

Second station 218 sprays one or more exterior surfaces 236 (e.g., technical face) of the open fabric with dye 214 as shown in FIG. 4. This is preferably achieved by controlling one or more spray nozzles 228 (only two shown) to spray the fabric 212 with dye 214. Preferably, nozzle 228 moves in a direction 238 that is perpendicular to machine direction 222.

In some embodiments, process 210 includes fifth station 232 positioned between second station 218 and third station 220. Fifth station 232 can include a heating device 234 for adjusting the moisture content of fabric 212 after application of dye 214 at second station 118, but before exposure to the steam of third station 220. Importantly, fifth station 212 does not dry dye 214 or fabric 212. Rather, fifth station 232 adjusts the moisture content of fabric 212 to a desired range. Preferably, fifth station 232 adjusts the moisture content of fabric 212 to between about 20% to about 80% prior to exposure to third station 220.

Third station 220 exposes fabric 212 to atmospheric steam (i.e., steam at atmospheric pressure) before dye 214 dries on the fabric. As discussed above, third station 220 exposes fabric 212 to steam and heat in a manner and amount sufficient to spread dye 214 throughout fabric 212 (e.g., from the technical face to the technical back) and affix the dye to the fabric as the fabric is continuously moved through the third station.

Preferably, process 210 closes fabric tube 212 while maintaining the fabric taut before entry into third station 220 by, for example, running the fabric through a set of nip rollers 240.

In some embodiments, third station 220 can increase the dwell time of fabric 212 within the third station, while decreasing the size of the third station by routing the fabric through a series of vertically arranged rollers 242. Of course, it is contemplated by the present disclosure for rollers 242 to be horizontally arranged, angled with respect to the horizontal or vertical, or any combinations thereof. It is also contemplated to adjust the speed of rollers 242 with respect to one another so that fabric 212 relaxes as it moved through third station 220. Advantageously, the rollers 242 are configured to minimize the contact between fabric 212 and third station 220 during the fixation process.

After dye 214 has been spread through and affixed to fabric 212 at third station 220, process 210 exposes fabric 212 to a fourth station 230 to wash off or remove any unfixed dye from the fabric. Fourth station 230 returns fabric 212 to the open state using a second air bearing opening unit 224 and exposes fabric 212 to a first rinse unit 244.

First rinse unit 244 rinses the open fabric tube 212 with pressurized hot water having a temperature of between about 40 to about 80 degrees Celsius, with about 70 degrees Celsius being preferred. The use of pressurized hot water ensures the minimal use of water. In addition, it is believed that the pressure of the hot water can assist in reducing shrinkage of fabric 212 by bulking the fabric during the rinse.

Next, fourth station 230 closes the fabric tube 212 by running the fabric through a second set of nip rollers 240 to extract the rinse water and unattached dye from the fabric. In some embodiments, fourth station 230 can expose fabric 212 to a second rinse unit 246 that rinses fabric 212 with pressurized hot rinse water having a temperature of between about 40 to about 80 degrees Celsius, with about 70 degrees Celsius being preferred.

In some embodiments, fourth station 230 can also include a pH adjustment device. For example, first rinse unit 244 and/or second rinse unit 246 can spray rinse water having a predetermined pH level so that the rinse water adjusts the pH of the dyed fabric to a pH that is neutral and/or slightly acidic.

In other embodiments, fourth station 230 can also be used to apply finishing components to fabric 212. For example, first rinse unit 244 and/or second rinse unit 246 can spray rinse water having a finishing component, such as the aforementioned pH adjusting component, a fabric softener, a fragrance, a stain repellant component, a water repellant component, any other fabric finishing component, and any combinations thereof.

Finally, fourth station 230 extracts the rinse water and unattached dye from the fabric by running the fabric through a third set of nip rollers 240.

Figure 5:
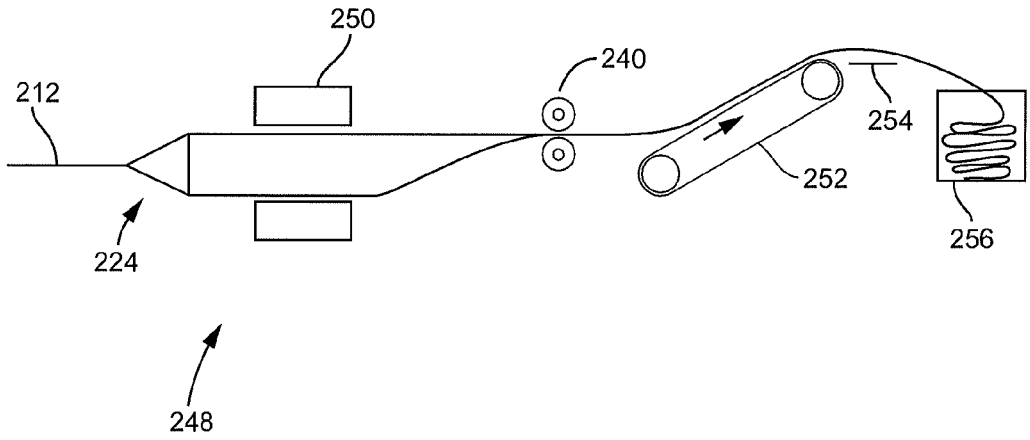
FIG. 5 is a schematic view of an exemplary embodiment of a collection unit for collecting finished fabric from the automated process of FIG. 3.

Process 210 can then collect the finished fabric 212 at a collection unit 248. An exemplary embodiment of a collection unit 248 according to the present disclosure is described with reference to FIG. 5. Collection unit 248 includes opening unit 224, a steam box 250, an inclined relaxing conveyor 252, a platter 254, and a fabric buggy 256.

Fabric 212 exiting second rinse unit 246 is opened by opening unit 224 and travels through steam box 50. Steam box 50 adjusts the moisture level of fabric 212 to between about 70% to about 80%. Without being limited to any particular theory, it is believed that the steam and moisture from steam box 250 is sufficient to insure the relaxation of fabric 212 prior to drying for purposes of controlling shrinkage of the fabric during drying.

Collection unit 248 then deposits fabric 212 on inclined relaxing conveyor 252 in a tensionless state. Fabric 212 exits conveyor 252 via platter 254 into buggy 256.

Advantageously, the processes 10, 110, 210 according to the present disclosure are continuous processes that expose the fabric to atmospheric steam without the need for expensive closed steaming chambers and without the need from a drying step before steaming. Accordingly, the processes according to the present disclosure can dye the fabric at a rate as high as about 50 yards per minute, preferably between about 3 yards per minute and about 30 yards per minute, more preferably about 20 yards per minute, and any subranges therebetween.

It should be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that this invention will include all embodiments falling within the scope of the present disclosure.

The invention claimed is:

1. A process for dyeing fabric, comprising:

continuously moving a tubular fabric in a machine direction, the tubular fabric having an outer surface and an inner surface;

drawing the tubular fabric over a former, the former comprising one of a frame having a substantially planar surface and a substantially tubular frame, to provide a substantially taut surface across the fabric to remove folds or creases, the former opening the tubular fabric so that the inner surface is not in contact with itself or the former and dye bounce off is reduced when the tubular fabric is sprayed with dye;

advancing the taut and open tubular fabric horizontally through an interconnected dye station and spraying downwardly relative to the outer surface of the fabric with dye;

advancing the fabric through an interconnected fixation station and exposing the fabric to atmospheric steam after spraying dye on said outer surface but prior to said dye drying on said outer surface so that said dye migrates from said outer surface to the inner surface of the fabric and reacts with and affixes to the fabric;

advancing the fabric through a first interconnected rinsing station, wherein unfixed dye is removed from the fabric by a pressurized water spray rinse; and extracting the rinse water and any unfixed dye from the fabric.

2. The process as in claim 1, further comprising adjusting a moisture content of the fabric to a predetermined content after application of said dye, but before exposure to said atmospheric steam.

3. The process as in claim 2, wherein said predetermined content comprises between about 20% and 80%.

4. The process as in claim 2, wherein adjusting said moisture content of the fabric comprises applying heat to the fabric in sufficient amount to act as a catalyst to start said dye reacting with and affixing to the fabric.

5. The process as in claim 1, wherein said rinse water has a pH sufficient to adjusts a pH of the dyed fabric to a pH that is neutral or slightly acidic.

6. The process as in claim 1, further comprising applying a finishing component to the fabric after exposing the fabric to said atmospheric steam.

7. The process as in claim 6, wherein said finishing component is selected from the group consisting of a pH adjusting component, a fabric softener, a fragrance, a stain repellant component, a water repellant component, and combinations thereof.

8. The process as in claim 1, wherein the fabric comprises synthetic fibers, natural fibers, and combinations thereof.

9. The process as in claim 1, wherein said first and second surfaces have a substantially uniform color.

10. A process for dyeing fabric, comprising:

continuously moving a tubular fabric in a machine direction, the tubular fabric having an outer surface and an inner surface;

opening the tubular fabric by drawing the fabric over a former, the former comprising one of a frame having a substantially planar surface and a substantially tubular frame, to provide a substantially taut surface across the fabric to substantially remove folds or creases, and so that the inner surface is not in contact with itself or the former and dye bounce off is reduced when the tubular fabric is sprayed with dye;

advancing the open taut tubular fabric horizontally through an interconnected dye station and spraying downwardly relative to the outer surface of the fabric with dye while the fabric is open;

advancing the fabric through an interconnected fixation station and exposing the fabric to atmospheric steam after spraying dye on said outer surface but prior to said dye drying on said outer surface so that said dye migrates from said outer surface to the inner surface of the fabric and reacts with and affixes to the fabric;

advancing the fabric through a first interconnected rinsing station, wherein unfixed dye is removed from the fabric by a pressurized water spray rinse; and extracting the rinse water and any unfixed dye from the fabric.

11. The process as in claim 10, further comprising adjusting a moisture content of the fabric to a predetermined content after application of said dye, but before exposure to said atmospheric steam.

12. The process as in claim 11, wherein said predetermined content comprises between about 20% and 80%.

13. The process as in claim 11, wherein said moisture content of the fabric is adjusted while the fabric is open.

14. The process as in claim 13, further comprising closing the fabric while maintaining the fabric taut before exposing the fabric to atmospheric steam, but after adjusting said moisture content.

15. The process as in claim 11, wherein adjusting said moisture content of the fabric comprises applying heat to the fabric in sufficient amount to act as a catalyst to start said dye reacting with and affixing to the fabric.

16. The process as in claim 10, further comprising closing the fabric while maintaining the fabric taut before exposing the fabric to atmospheric steam.

17. The process as in claim 10, further comprising reopening the fabric after exposing the fabric to said atmospheric steam, but before rinsing unfixed dye from the fabric.

18. The process as in claim 10, further comprising applying a finishing component to the fabric after exposing the fabric to said atmospheric steam.

19. The process as in claim 18, wherein said finishing component is selected from the group consisting of a pH adjusting component, a fabric softener, a fragrance, a stain repellant component, a water repellant component, and combinations thereof.

20. The process as in claim 10, wherein said first and second surfaces have a substantially uniform color.

21. A process for continuously dyeing a tubular fabric having an inner surface and an outer surface, comprising:

opening the tubular fabric by drawing the fabric over a former, the former comprising one of a frame having a substantially planar surface and a substantially tubular frame, and maintaining the fabric substantially taut across the fabric to remove folds or creases, and so that the inner surface is not in contact with itself or the former and dye bounce off is reduced when the tubular fabric is sprayed with dye;

advancing the open taut tubular fabric horizontally through an interconnected dye station and spraying downwardly relative to the outer surface of the open tubular fabric with dye;

closing the tubular fabric;

advancing the tubular fabric through an interconnected fixation station and exposing the closed tubular fabric to atmospheric steam after spraying dye on said outer surface but prior to said dye drying on said outer surface so that said dye migrates from said outer surface to the inner surface of the tubular fabric and reacts with and affixes to the tubular fabric;

advancing the tubular fabric through a first interconnected rinsing station, wherein unfixed dye is removed from the tubular fabric by a pressurized water spray rinse; and extracting the rinse water and any unfixed dye from the tubular fabric.

* * * * *